US005191849A

United States Patent [19]

Labrucherie et al.

[11] Patent Number: 5,191,849

[45] Date of Patent: Mar. 9, 1993

[54] MULTI-HULLED BOAT

[76] Inventors: Mark Labrucherie, 105 ru du Champ de Mont, Varanval 60880 le Meux, France; Daniel Tollet, Regence Park, Apartment 313, Avenue Jean Moulin, 83400 Hyeres, France

[21] Appl. No.: 695,822

[22] Filed: May 6, 1991

[51] Int. Cl.[5] ..... B63B 1/12

[52] U.S. Cl. ..... 114/61; 114/290

[58] Field of Search ..... 114/67 A, 61, 290, 56

[56] References Cited

U.S. PATENT DOCUMENTS

| | | | |
|---|---|---|---|
| 2,321,531 | 6/1943 | Thompson | 114/61 X |
| 3,316,873 | 5/1967 | Dismukes | 114/61 |
| 3,342,278 | 9/1967 | Cocksedge | 114/67 A |
| 3,470,839 | 10/1969 | Faul et al. | 114/61 |

FOREIGN PATENT DOCUMENTS

| | | | |
|---|---|---|---|
| 2586001 | 2/1987 | France | 114/61 |
| 9001000 | 2/1990 | World Int. Prop. O. | 114/290 |

*Primary Examiner*—Sherman Basinger

*Attorney, Agent, or Firm*—Seyfarth, Shaw, Fairweather & Geraldson

[57] ABSTRACT

A multi-hulled boat has at least three hulls, with the outside hulls extending forward beyond the central or inside hull or hulls. The hulls are tapered with a cross-sectional configuration that increases in side front to rear, thus forming a channel or tunnel between adjacent hulls which decreases in cross-sectional size front to rear. Air entering the tunnels is compressed, thus imparting a lifting force to the hulls lifting the hulls partially out of the water to decrease the hydraulic drag on the hulls. The hulls have identical cross-sectional areas at identical transverse planar sections thereof. The bottom of each hull is flat and inclined at an angle with the horizontal. The hull bottoms join the hull sides at a chamfer which increases in size front to rear. Shutters or flaps may be used to partially or fully close off the tunnels between the hulls to control airflow or to trap water-borne material to be collected and recycled.

3 Claims, 2 Drawing Sheets

MULTI-HULLED BOAT

FIELD OF THE INVENTION

The present invention generally concerns designs of boat hulls and more particularly to multi-hulled boats.

BACKGROUND OF THE INVENTION

Boats having several parallel hulls already exist and are well known. For instance, boats with two hulls are known as "catamarans." There are also three-hulled boats, or "trimarans" wherein the central hull is longer than the side hulls, with the side hulls used more as stabilizing floats rather than as hulls proper.

In French Patent No. 2,586,001, there is disclosed a four-hulled boat in which the central or inside hulls are shorter in length than the side or outside hulls. Such a hull structure helps improve the boat's performance by reducing its draft and improving its stability.

BRIEF DESCRIPTION OF THE INVENTION

The present invention concerns a boat having at least three parallel hulls attached to the underside of the boat bottom, with each central or inside hull being shorter in length than the side hulls with the rear walls of each hull being coplanar and with the front edge of each inside hull set back from the front edge of the side hulls. The purpose of the present invention is to provide such a multi-hulled boat with improved or enhanced performance characteristics which require less powerful motors to propel the boat.

To accomplish this goal, the cross-sectional of the outside hulls and the inside hulls increases continuously from fore to aft, and the side walls of each hull are planar and generally vertical.

An inverted trough is thus formed by the boat bottom and the hull sidewalls of adjacent hulls defining an air passage or "tunnel" as described hereinbelow. Because the outside hulls are longer than the inside hulls and extend forward of the inside hulls at the front of the boat, the outside hulls form a type of funnel, forcing the air to rush into the tunnels created by the space between adjacent hulls. Because the width of the tunnels decreases fore to aft, the air pressure within each tunnel increases from fore to aft, providing the boat with a lifting force. When the boat is lifted from the water, the submerged volume is reduced, allowing the boat to obtain excellent performance while requiring a lower power output from the boat's motors.

Another feature of the present invention is that the bottom of each hull is substantially flat and is tilted at an angle of 0.5° to 5° with the horizontal. As the boat begins to lift upward with an increase in speed, the flat, sloped bottoms of the hulls create an aerodynamic drag which produces a dynamic lift. The preferred angle of tilt of the hulled bottoms is preferably between 1° and 3°.

Yet another advantage to the present invention is that the downward-facing surface of the boat's bottom which covers the tops of the hulls slopes upwardly from rear to front. Preferably, the downward-facing surface of the boat bottom is roughly parallel to the bottom surface of the hulls. As a result, the height of the tunnel separating adjacent hulls diminishes from front to rear which further enhances the phenomenon of air compression, once again improving aerodynamic lift. It should be noted that the air compression is accomplished with a perfectly laminar airflow due to the overall profile of the hulls as described hereinabove.

To facilitate the manufacturing of the hulls and give the hulls good shock absorption characteristics in water, the bottom of each hull is connected to each lateral or side wall of each hull by means of a flat, partially-tilted surface, forming a chamfer. The angle of this chamfer decreases continuously from back to front in conjunction with the the tilt of the hull bottom until the chamfer is totally horizontal at the front part of the hull. Consequently, the height of the chamfer determines the slope of the bottom of each hull.

The backs of each hull all lay in a single plane perpendicular to the boat's axis and the hulls are all identically sized and shaped, and thus all have identical cross-sections at identical points along their lengths to the front of the shortest hulls. This feature makes construction of the boat easier because all hulls are identical from the back to the front of the shortest hulls. The outside hulls, which are longer than the shorter inside hulls, have streamlined extensions built at the front to enable the outside hulls to extend forward beyond the ends of the inside hulls.

Each tunnel between adjacent hulls may be equipped with a flap or shutter hinged horizontally at its fore-edge under the boat bottom between adjacent hulls, roughly at the mid-length of the boat, each shutter having a control means, such as a hydraulic jack to adjust, if need be, the airflow through the tunnels and, thereby, the tilt of the boat.

This type of boat which may have, for example, four hulls or more, has advantages because of the lift capability it features, which enables the use of a smaller engine to drive the boat than if the hulls did not lift out of the water while the boat is under way. Furthermore, it should be noted that it is an advantage to increase the number of low-powered engines used by placing one such engine in each hull, thereby providing an extra margin of safety because in the case of the failure of one engine, the boat can sail on using the other engines. The engines can be conventional propeller-driving type engines or surface propulsive engines of the hydrojet type. In accordance with the usable volume within the boat hulls and the lightness of the construction, the boat can be made unsinkable by filling each hull with expanded thermoplastic material such as polystyrene rated, for example, at 30 kilograms per cubic meter.

Such a boat can be used either for leisure or for more commercial purposes such as transporting passengers or as ferries for carrying cars and freight. In any case, the boat is lifted from the water as it reaches the speed of about 15 knots and the submerged surface area is greatly reduced because the length of the water line is reduced by two-thirds while the boat is cruising.

It is also possible to consider other uses for this type of boat, such as helping in the battle against pollution by collecting trash floating on the water utilizing the tunnels between the different hulls to pick up floating waste due to the flaps hinged along the aft edge of the hulls and to store the waste in settling or collecting bins at the back of the boat.

The invention will be more easily understood upon a consideration of the accompanying drawings. The drawings herein show the boat in a configuration intended for leisure use, but is not intended to limit the scope of the invention.

Figure 2:
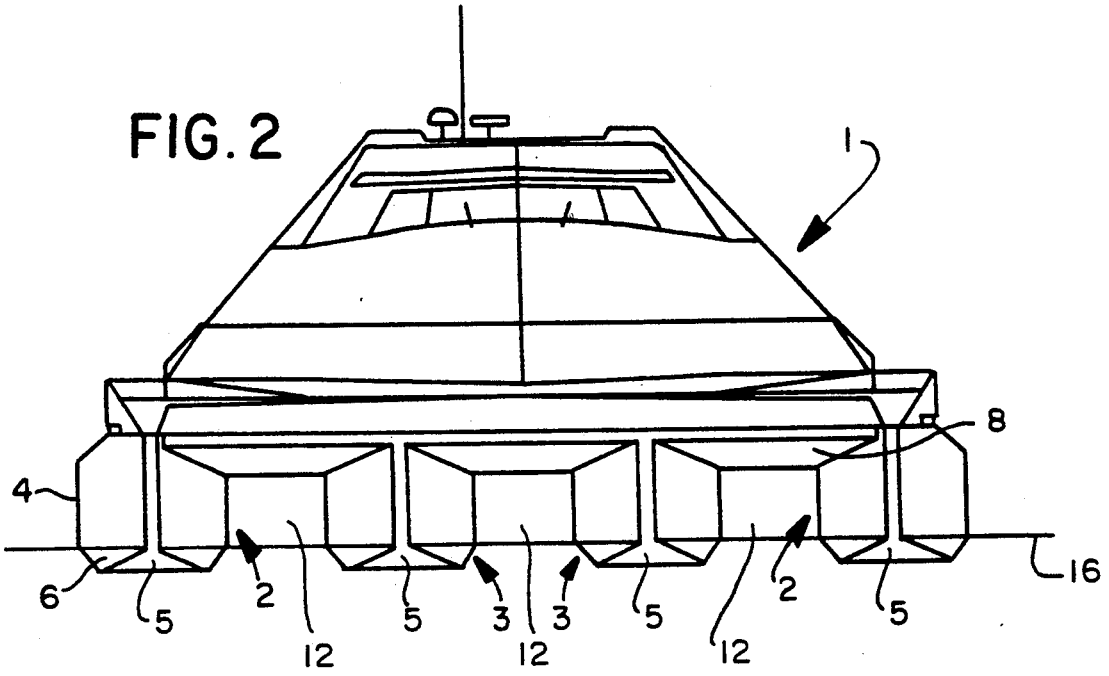
FIG. 2 is front view of the boat shown in FIG. 1.
Figure 3:
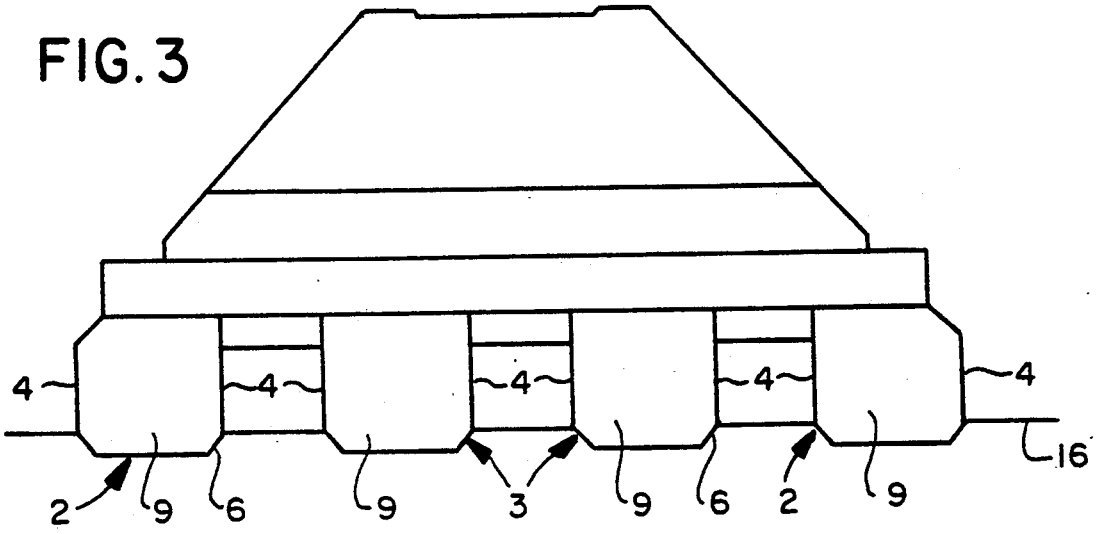
FIG. 3 is a rear view of the boat shown in FIG. 1.

As shown in the drawings, and referring to FIGS. 2 and 3, a boat 1 of the present invention has four hulls in two sets of two identical hulls each, namely, two outside hulls 2 and two inside hulls 3. The backs 9 of each outside hull 2 and each central hull 3 are coplanar in a plane perpendicular to the fore-and-aft axis of the boat.

As shown in the drawings, each outside hull 2 and inside hull 3 has a generally triangular shape as viewed from a horizontal plane above the hulls with the width of each hull increasing continuously from front to rear. Furthermore, as shown particularly in FIG. 3, side walls 4 of each hull 2, 3 are substantially vertical and planar or flat.

Figure 4:
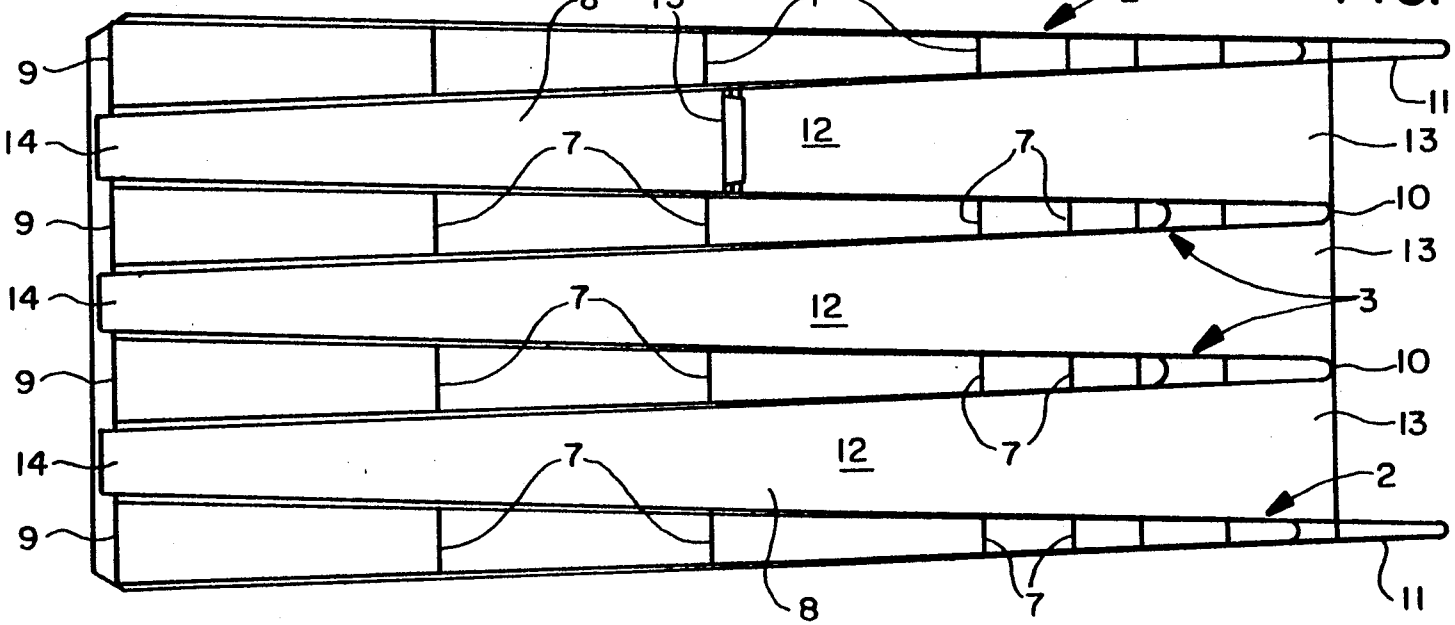
FIG. 4 is a cross-sectional view along line IV—IV of FIG. 1.

As best seen in FIG. 4, hulls 2, 3 are identical in shape, size and construction. Preferably 2, 3 are assembled to boat 1 with rear walls 9 aligned in a single plane perpendicular to the fore-and-aft axis of boat 1. Thus, the cross-sectional shapes and areas of all hulls will be identical when measured at identical points along the hulls' lengths.

Figure 1:
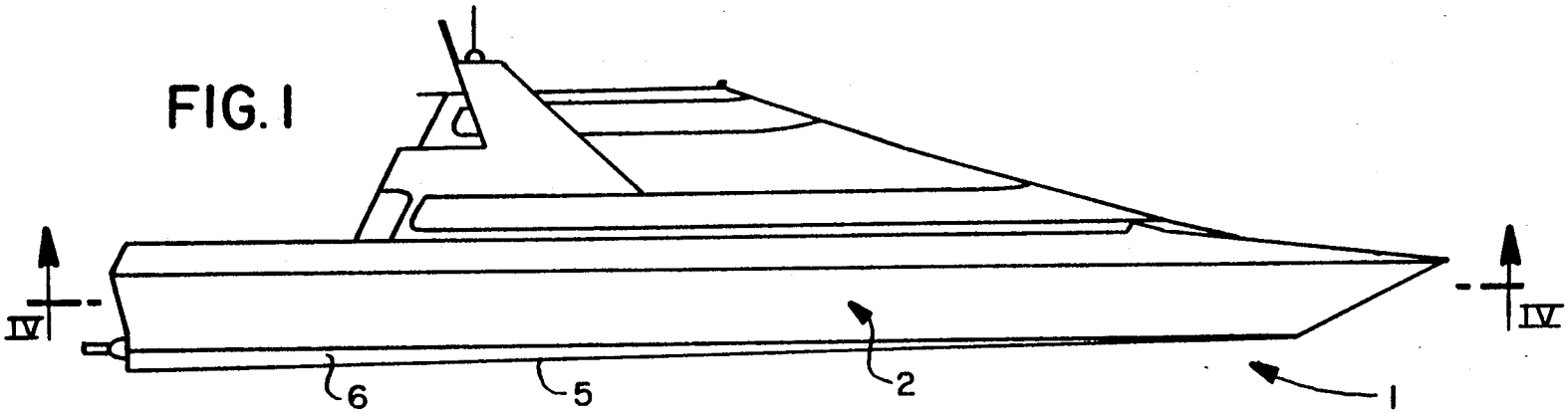
FIG. 1 is a side view of a boat embodying the present invention.

In accordance with yet another feature of the present invention, and as shown in FIGS. 1 and 2, bottom 5 of each hull is substantially flat and sloped upward from rear to front at an angle between 0.5° and 5°, preferably at an angle between 1° and 3° as measured from the horizontal.

The bottom 5 of each hull is connected to the corresponding sides 4 by a flat, partially tilted hull surface 6 forming a chamfer. The height or size of chamfer 6 decreases continuously from back to front as a result of the tilt of each hull bottom 5. This shape results in easy-to-build low-cost hulls that can be made of low density metal or metal alloys such as aluminum alloy.

As seen in FIG. 4, the hulls are assembled conventionally, using transverse braces 7 to impart lateral rigidity and stability to hull walls 4.

The fact that the cross-sections of outside hulls 2 and inside hulls 3 are identical along the entire lengths of the hulls extending to the front edges 10 of the shortest hulls facilitates manufacturing and allows manufacturing to be standardized, as the two outside hulls 2 are the same in shape as inside hulls 3 except for streamlined extensions 11 attached at the front of each side hull 2.

Hulls 2 and 3 are attached one to the other to boat bottom 8 lower surface. In a preferred embodiment, bottom 8 is pitched upward from rear to front. This pitched feature, as well as the increasing cross-sectional area of the hulls front to back contributes to reducing the size of the air passage between adjacent hulls which enhances the lift phenomenon.

As seen in FIGS. 2 and 3, a tunnel 12 is formed between each pair of adjacent hulls, each said tunnel 12 being defined by a pair of opposed hull sides walls 4 and bottom 8. As best seen in FIG. 4, each tunnel 12 has a larger cross-sectional area at its entry 13 than at its exit 14. As best seen in FIG. 2, the tilt of bottom 8 also decreases the cross-sectional area of each tunnel 12 along the tunnel length from front to rear. The narrowing of each tunnel 12 along the path of airflow there through compresses the air within the tunnels, causing the lift effect described earlier.

As further shown in FIGS. 2, 3 and 4, adjacent hulls 2, 3 or 3, 3 are spaced the same distance apart. All tunnels 12 are thus substantially identically sized and shaped to present substantially identical flow paths for air passing therethrough.

Referring now to FIG. 4, the numeral 15 indicates generally a shutter or flap positioned approximately midway between entrance 13 and exit 14 of tunnel 12. It is contemplated that one such shutter 15 may be placed within each such tunnel 12. Adjusting controls (not herein specifically shown) are provided to adjust the angle of shutter 15 and, consequently, the extent to which shutter 15 covers or closes off tunnel 12. Shutter 15 may be variously used to trap or collect trash or debris within tunnel 12, or to affect or control the degree to which hulls 2, 3 are lifted above water line 16 while boat 1 is under way.

The boat shown in the accompanying drawings has a superstructure corresponding to that of a yacht, but could also have other superstructures as well as, for example, if the boat were designed to collect trash on the water. In that case, it would be necessary to place shutters in the tunnels to trap waste and direct it to settling tanks which could also be located at the back of the boat.

As shown herein, the present invention demonstrates improvements to existing boat construction techniques by offering a boat with a simple design, high performance driven by low-powered motors which results in savings both in terms of manufacturing costs as well as use and maintenance.

The foregoing has described a specific embodiment of the present invention, it is not intended that the invention be limited only to the example herein described and shown. The present invention could also apply to a variety of different boat configurations and the description is not intended to limit the spirit and scope of the invention described and claimed herein.

For example, the number of hulls can be different so long as the inside hulls are shorter than the outside hulls to preserve the funnel system which directs air to the tunnels between the hulls. In addition, the tunnels could be closed off at their openings by attached shutters while still remaining within the boundaries of the invention described herein.

What is claimed is:

1. A multi-hull boat comprising:

a superstructure having a boat bottom, a pair of outside hulls parallel to each other and attached at said bottom, at least one inside hull attached at said bottom parallel to and disposed between said outside hulls, each said outside hull having a hull extension on said front end whereby said outside hulls extend forward of said at least one inside hull, said inside and outside hulls each having a continuously increasing cross-sectional area from said front end to said rear end, each hull having a substantially flat hull bottom sloping upwardly from rear to front at an angle between 0.5° and 5° from the horizontal.

2. A boat as set forth in claim 1, wherein each such hull has a plane surface set at an intermediary bank angle, acting as a chamfer and joining each hull bottom to each hull side, said banked surface having a steadily decreasing height from rear to front.

3. A boat as set forth in claim 1 wherein said bottom has a downward slope from front to rear.

* * * * *